US010535942B2

(12) United States Patent
Sugiura et al.

(10) Patent No.: US 10,535,942 B2
(45) Date of Patent: Jan. 14, 2020

(54) SPRING CONNECTOR

(71) Applicant: YOKOWO CO., LTD., Kita-ku, Tokyo (JP)

(72) Inventors: Kenta Sugiura, Tomioka (JP); Yoshihiro Tanai, Tomioka (JP)

(73) Assignee: YOKOWO CO., LTD., Kita-ku, Tokyo (JP)

( * ) Notice: Subject to any disclaimer, the term of this patent is extended or adjusted under 35 U.S.C. 154(b) by 0 days.

(21) Appl. No.: 16/115,846

(22) Filed: Aug. 29, 2018

(65) Prior Publication Data

US 2019/0109397 A1 Apr. 11, 2019

(30) Foreign Application Priority Data

Oct. 5, 2017 (JP) ..... 2017-194868

(51) Int. Cl.

| | |
|---|---|
| ***H01R 13/17*** | (2006.01) |
| ***H01R 13/08*** | (2006.01) |
| ***H01R 13/03*** | (2006.01) |
| ***H01R 13/24*** | (2006.01) |

(52) U.S. Cl.

CPC ..... *H01R 13/17* (2013.01); *H01R 13/03* (2013.01); *H01R 13/08* (2013.01); *H01R 13/2421* (2013.01); *H01R 13/2464* (2013.01)

(58) Field of Classification Search

CPC .... H01R 13/03; H01R 13/17; H01R 13/2421; H01R 13/2428; H01R 4/4809; H01R 4/4881

See application file for complete search history.

(56) References Cited

U.S. PATENT DOCUMENTS

| | | | | |
|---|---|---|---|---|
| 3,805,216 A * | 4/1974 | Gaspar | H01R 13/2421 | 439/332 |
| 4,904,213 A * | 2/1990 | Hock | G01R 1/067 | 439/482 |
| 5,358,432 A * | 10/1994 | Shih | H01R 13/17 | 439/655 |
| 5,681,187 A * | 10/1997 | Fukushima | H01R 13/187 | 439/138 |
| 6,861,862 B1 * | 3/2005 | Tate | G01R 1/0466 | 324/756.02 |
| 6,994,600 B2 * | 2/2006 | Coulon | H01R 13/187 | 439/843 |

(Continued)

FOREIGN PATENT DOCUMENTS

| | | |
|---|---|---|
| JP | 2006-066305 A | 3/2006 |
| WO | 2006/025510 A1 | 3/2006 |

*Primary Examiner* — Edwin A. Leon
*Assistant Examiner* — Milagros Jeancharles
(74) *Attorney, Agent, or Firm* — Morgan, Lewis & Bockius LLP

(57) ABSTRACT

A spring connector includes a movable pin, a conductive tube accommodating a base portion of the movable pin, a spring provided in the conductive tube so as to urge the movable pin in a direction, in which the movable pin protrudes from the conductive tube, and a plate spring contact including a plurality of plate springs that electrically connect the movable pin and the conductive tube to each other. The plurality of plate springs are provided around an entire circumference of the movable pin and are in elastic contact with an inner circumferential surface of the conductive tube, respectively.

20 Claims, 4 Drawing Sheets

(56) References Cited

U.S. PATENT DOCUMENTS

| | | | | |
|---|---|---|---|---|
| 7,682,206 | B2 * | 3/2010 | Kainz | H01R 13/187 439/700 |
| 8,062,078 | B2 * | 11/2011 | Asai | H01R 13/2421 439/482 |
| 8,337,256 | B1 * | 12/2012 | Lin | 439/700 |
| 8,734,189 | B2 * | 5/2014 | Kim | H01R 13/2421 439/482 |
| 8,905,795 | B2 * | 12/2014 | Kim | H01R 13/62 439/700 |
| 8,926,376 | B2 * | 1/2015 | Mori | H01R 13/2421 439/700 |
| 9,225,095 | B2 * | 12/2015 | Van Ekstrom | H01R 13/2421 |
| 9,780,475 | B2 * | 10/2017 | Kim | H01R 13/62 |
| 10,181,669 | B2 * | 1/2019 | Tsai | H01R 13/2478 |
| 2014/0256163 | A1 * | 9/2014 | Kuo | H01R 13/6205 439/39 |

* cited by examiner

*Fig. 7* *RELATED ART*
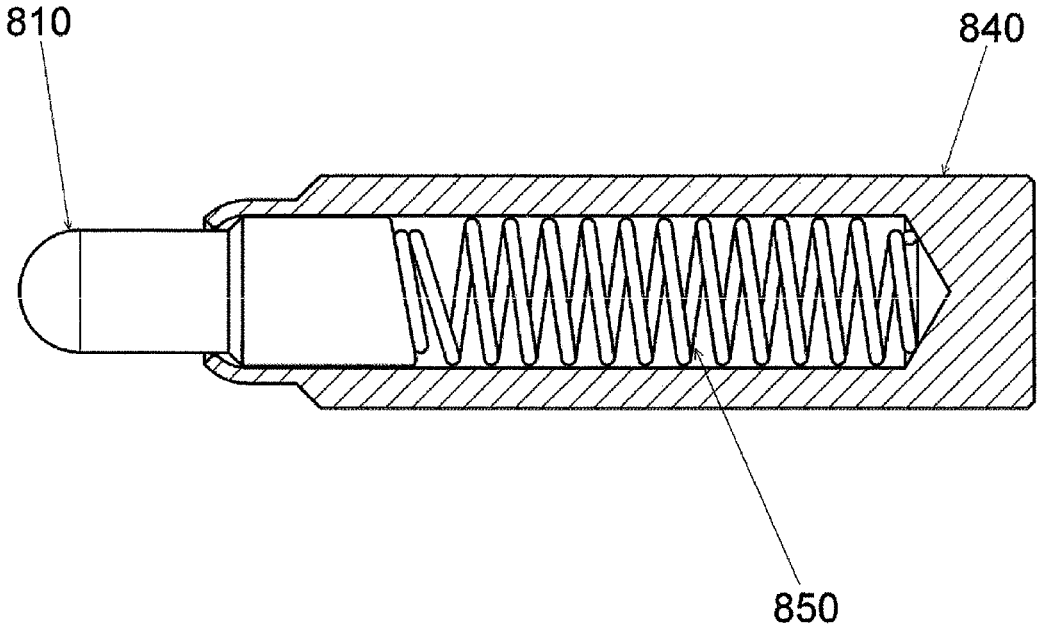

SPRING CONNECTOR

CROSS REFERENCE TO RELATED APPLICATIONS

This application is based on Japanese Patent Application (No. 2017-194868) filed on Oct. 5, 2017, the contents of which are incorporated herein by way of reference.

BACKGROUND

The present invention relates to a spring connector used in electric connection.

A spring connector illustrated in FIG. 7 according to the related art has a structure, in which a movable pin 810 is tilted by urging a bias-cut base end surface thereof with a spring 850, so that an outer circumferential portion of a base end of the movable pin 810 is brought into contact with an inner circumferential surface of a conductive tube 840. However, in the above structure, since there is only one main electrical contact between the movable pin 810 and the conductive tube 840, high temperature heat is generated when the spring connector is used at high current, resulting in deterioration of stress of the spring 850. JP-A-2006-66305 discloses a structure in which a base portion of a movable pin is elastically biased in a direction nearly perpendicular to an axial direction by an elastic member and then is brought into elastic contact with an inner circumferential surface of a conductive tube.

SUMMARY

A first aspect of the present invention is to provide a spring connector capable of preventing heat generation due to an electric current flowing in a conductive tube from a movable pin.

A second aspect of the present invention is to provide a spring connector capable of reducing a risk of burning of a spring.

The spring connector according to the invention is characterized by the following (1) to (6).

(1) A spring connector including:

a movable pin;

a conductive tube accommodating a base portion of the movable pin;

a spring provided in the conductive tube so as to urge the movable pin in a direction, in which the movable pin protrudes from the conductive tube; and a plate spring contact including a plurality of plate springs that electrically connect the movable pin and the conductive tube to each other, wherein the plurality of plate springs are provided around an entire circumference of the movable pin and are in elastic contact with an inner circumferential surface of the conductive tube, respectively.

(2) The spring connector according to the above (1), further including:

an insulator that urges a fixing portion of the plate spring contact against the movable pin in the conductive tube by receiving a biasing force of the spring.

(3) The spring connector according to the above (2), wherein the insulator insulates the movable pin and the spring from each other.

(4) A spring connector including:

a movable pin;

a conductive tube accommodating a base portion of the movable pin;

a spring provided in the conductive tube so as to urge the movable pin in a direction, in which the movable pin protrudes from the conductive tube;

a plate spring contact including a plurality of plate springs that electrically connect the movable pin and the conductive tube to each other; and an insulator that urges a fixing portion of the plate spring contact against the movable pin in the conductive tube by receiving a biasing force of the spring, wherein each of the plurality of plate springs is in elastic contact with an inner circumferential surface of the conductive tube, and the insulator insulates the movable pin and the spring from each other.

(5) The spring connector according to any one of the above (2) to (4), wherein the movable pin includes a cylindrical portion with an opening in the base portion thereof, the insulator includes a cylindrical portion located in the cylindrical portion of the movable pin and a flange portion having a diameter that is greater than an inner diameter of the opening of the base portion of the movable pin, the spring extends in the cylindrical portion of the insulator, and a fixing portion of the plate spring contact is supported between the flange portion and the base portion of the movable pin.

(6) The spring connector according to any one of above (1) to (5), wherein the plate spring contact includes a connecting portion which connects at least one ends of the plurality of plate springs to one another.

BRIEF DESCRIPTION OF DRAWINGS

FIG. 7 is a cross-sectional view of a spring connector according to the related art.

DETAILED DESCRIPTION OF EXEMPLIFIED EMBODIMENTS

Figure 1:
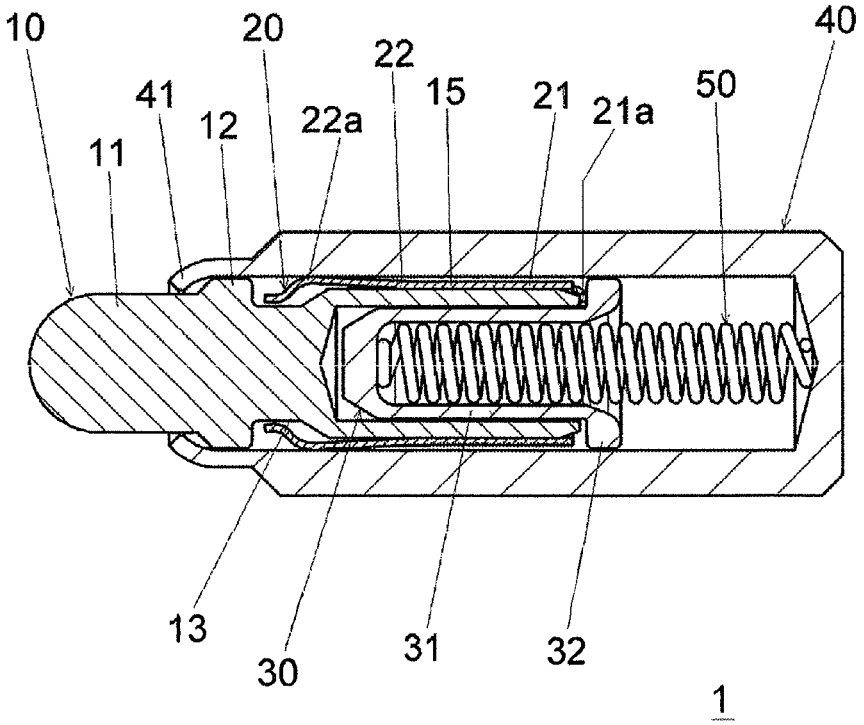
FIG. 1 is a cross-sectional view of a spring connector according to an embodiment of the present invention.

An object of the structure disclosed in JP-A-2006-66305 is to directly bring the movable pin and the inner circumferential surface of the conductive tube into contact with each other by an arbitrary elastic force, and the structure is to reduce a resistance value with one main electrical contact. However, an electric current is likely to be concentrated on the one main electrical contact, and thus, there is room for improvement in view of prevention of heat generation. In addition, since the spring is electrically connected to the movable pin, when the spring connector is used at a high current, currents flow into the spring, resulting in burning of the spring.

The present invention has been made in view of these circumstances, and the first aspect thereof is to provide a spring connector capable of preventing heat generation due to an electric current flowing in a conductive tube from a movable pin.

The second aspect of the present invention is to provide a spring connector capable of reducing a risk of burning of a spring.

Hereinafter, one or more embodiments of the present invention will be described with reference to accompanying drawings. It is to be noted that the same or equivalent components and members which are illustrated in the respective drawings will be denoted with the same reference numerals, and overlapped descriptions will be appropriately omitted. Moreover, the invention is not limited to the embodiments, but the embodiments simply exemplify the invention. All the features which are described in the embodiments and combinations of the features are not necessarily essential to the invention.

A spring connector 1 according to an embodiment of the present invention will be described below with reference to FIGS. 1 to 4. The spring connector 1 includes a movable pin 10, a plate spring contact 20, an insulator 30, a conductive tube 40, and a spring 50.

The movable pin 10 has a conductive metal body, and includes a protruding portion 11, a large diameter portion 12 for preventing pulling-out, a contraction portion (small diameter portion) 13, and a cylindrical portion 15 from a tip end side of the movable pin 10. The protruding portion 11 has a cylindrical shape, a tip end of which is processed to be a spherical shape, and an outer diameter of the protruding portion 11 is smaller than an inner diameter of a narrow portion 41 in the conductive tube 40. In addition, the protruding portion 11 protrudes outward from the conductive tube 40. The large diameter portion 12 is a protruding portion formed on a base portion side of the protruding portion 11 to circulate around an axial direction of the movable pin 10, and an outer diameter of the large diameter portion 12 is greater than the inner diameter of the narrow portion 41 in the conductive tube 40. When the large diameter portion 12 is coupled to the narrow portion 41, a dislocation of the movable pin 10 from the conductive tube 40 may be prevented. The contraction portion 13 has an outer diameter that is smaller than those of the large diameter portion 12 and the cylindrical portion 15, and accordingly, a space in which a tip end of a plate spring 22 urged and deformed by an inner circumferential surface of the conductive tube 40 is positioned is ensured. The cylindrical portion 15 has an outer diameter that is smaller than that of the large diameter portion 12 and greater than that of the contraction portion 13, and accommodates a cylindrical portion 31 of the insulator 30 and a part of the spring 50 therein.

Figure 3:
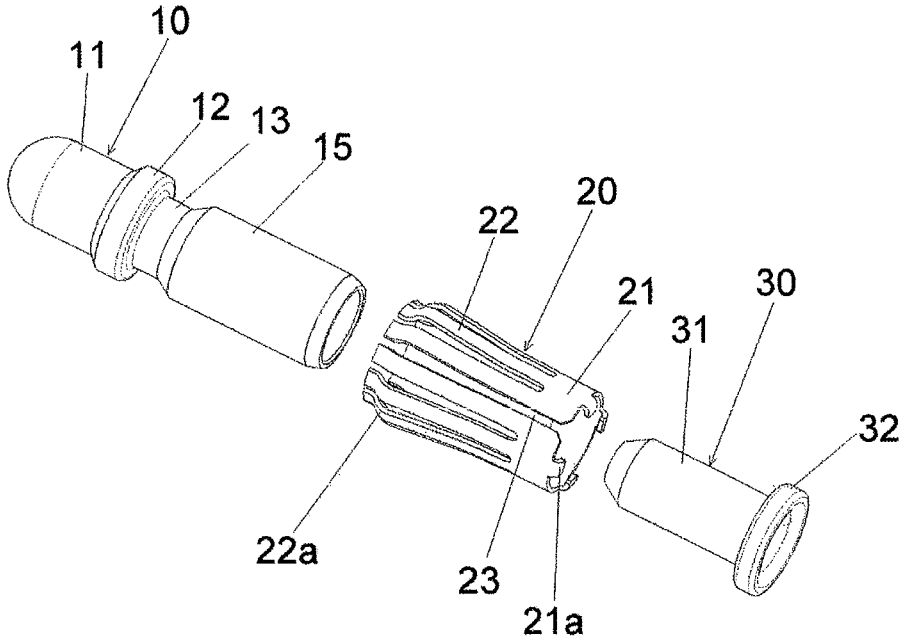
FIG. 3 is an exploded perspective view of the movable pin, a plate spring contact, and an insulator in the spring connector.
Figure 4:
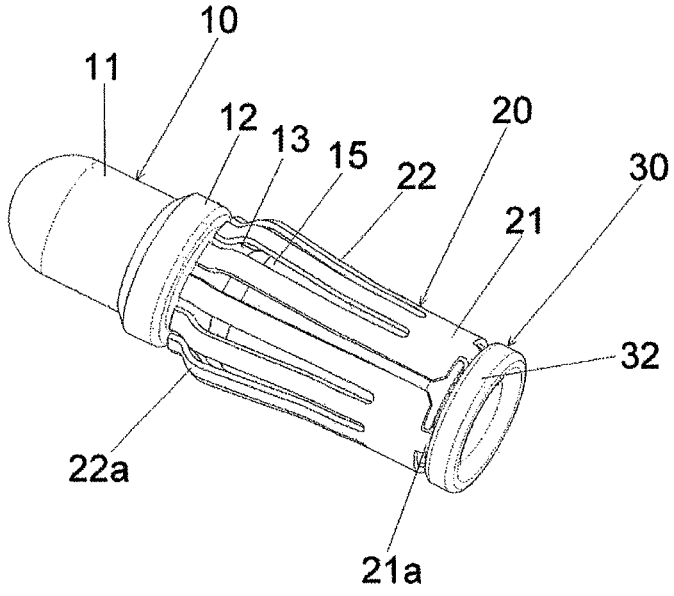
FIG. 4 is a perspective view of an assembled state of the spring connector.

The plate spring contact 20 is a sheet metal part formed by, for example, a sheet metal press process, and is a member for electrically connecting the movable pin 10 to the conductive tube 40. The plate spring contact 20 may be a molded body. The plate spring contact 20 includes a connecting portion 21 and a plurality of plate springs 22. Also, a slit 23 illustrated in FIG. 3 is a gap formed when the sheet metal is processed as a cylinder.

The connecting portion 21 is a part for connecting ends of the plurality of plate springs 22 to one another, and is a band portion that roughly circulates around an outer circumferential portion of a base portion in the cylindrical portion 15 of the movable pin 10 in a circumferential direction. An inner circumferential surface of the connecting portion 21 is contact with the outer circumferential surface of the cylindrical portion 15 of the movable pin 10. Before inserting the movable pin 10, the inner diameter of the connecting portion 21 is set to be slightly smaller than the outer diameter of the cylindrical portion 15 of the movable pin 10, so that the inner circumferential surface of the connecting portion 21 may be brought into contact with the outer circumferential surface of the cylindrical portion 15 (surface-contact) due to the spring of the connecting portion 21. A plurality of (four in the illustrated example) tongue portions 21*a* extend to protrude from the connecting portion 21 as fixing portions, around the axial direction with constant angle intervals therebetween. Alternatively, pitches among the tongue portions 21*a* may not be constant angle intervals, and even in this case, the tongue portions 21*a* may act as the fixing portions. Each of the tongue portions 21*a* curves inward in a radial direction, and extends between an opening end (opening end surface) of the cylindrical portion 15 of the movable pin 10 and a surface of a flange 32 of the insulator 30 at the plate spring contact 20 side. When each tongue portion 21*a* is supported between the opening end of the cylindrical portion 15 of the movable pin 10 (that is the base portion of the movable pin 10) and the surface of the flange 32 at the plate spring contact 20 side, the plate spring contact 20 is fixed onto the movable pin 10 so as to be prevented from pulling-out.

A plurality of plate springs 22 (preferably three or more, and more preferably five or more plate springs) are provided over an entire circumference around the axial direction at a portion closer to the base portion than the large diameter portion 12 of the movable pin 10. Each of the plate springs 22 having a cantilever structure elastically contacts an inner circumferential surface of the conductive tube 40 to be spreadable from the connecting portion 21 towards a tip end of the movable pin 10 in a radially outward direction. The plate spring 22 extends to a position radially outside from the inner circumferential surface of the conductive tube 40 before being accommodated in the conductive tube 40, but when the plate spring 22 is accommodated in the conductive tube 40, the plate spring 22 is urged to a radially inward direction by the inner circumferential surface of the conductive tube 40 and deformed, and then, elastically contacts the inner circumferential surface of the conductive tube 40 due to a recovery force of the deformation. Each of the plate springs 22 includes a curved portion 22*a* that is curved radially inward at an end extending to the radially outside, and an external surface (R surface) of the curved portion 22*a* elastically contacts the inner circumferential surface of the conductive tube 40 and an edge of the plate spring 22 is bent inward in the radial direction. Thus, the inner circumferential surface of the conductive tube 40 may not be damaged due to the edge of the plate spring 22. The plate spring 22 may have a structure, in which opposite ends thereof are supported. In other words, tip ends of the plate springs 22 at a side of the other end of the movable pin 10 may also be connected by a connecting portion.

The insulator 30 may be, for example, an insulating resin molded body, and includes the cylindrical portion 31 and the flange 32. The cylindrical portion 31 has a cylinder shape having a bottom, and is located inside the cylindrical portion 15 of the movable pin 10. The spring 50 extends in the cylindrical portion 31. The flange 32 is provided at one end of the cylindrical portion 31, and thereby an outer diameter of the flange 32 is greater than an inner diameter of the cylindrical portion 15 of the movable pin 10. The insulator 30 is biased (urged) by the spring 50 towards the movable pin 10, and then, due to the biasing force (urging force), the flange 32 urges each of the tongue portions 21*a* of the plate spring contact 20 towards the opening end of the cylindrical portion 15 of the movable pin 10. The movable pin 10 and the spring 50 are not be in contact with each other and insulated from each other by the insulator 30.

The conductive tube 40 has a conductive metal body of a cylindrical shape having a bottom, and accommodates the base portion of the movable pin 10 (the large diameter portion 12 and a portion closer to the base portion side), the plate spring contact 20, the insulator 30, and the spring 50, when the conductive tube 40 is not in a urged state. Alternatively, the conductive tube 40 may have a cylindrical shape with no bottom, and in this case, another member that is not illustrated in the drawings may replace with the bottom portion. A tip end of the conductive tube 40 is the narrow portion 41, and because the inner diameter of the narrow portion 41 is smaller than the outer diameter of the large diameter portion 12, the movable pin 10 is prevented from pulling-out from the conductive tube 40.

Figure 2:
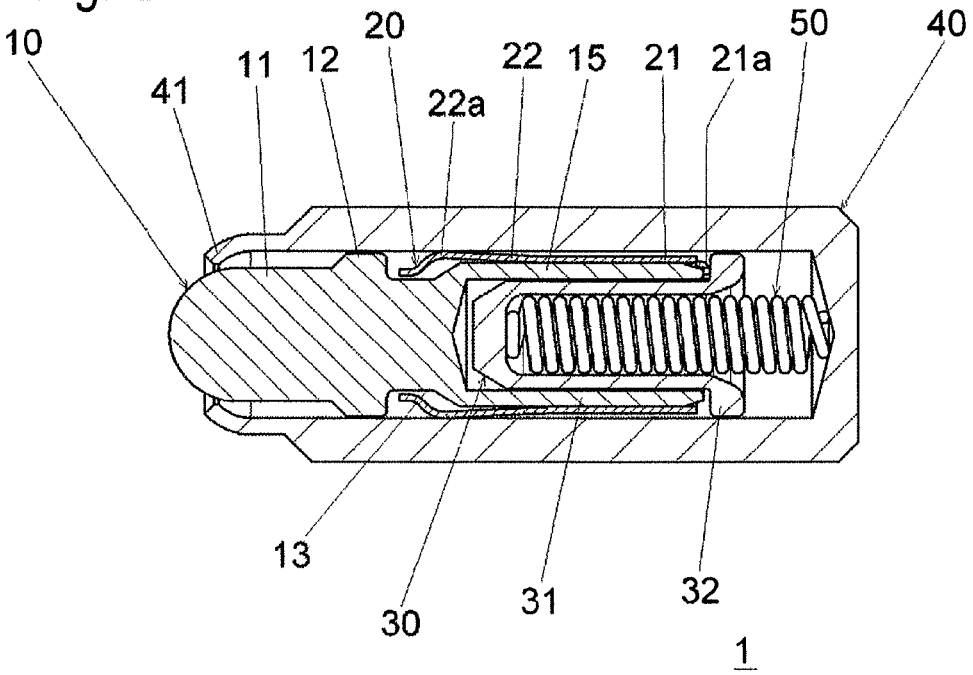
FIG. 2 is a cross-sectional view of the spring connector in a state where a movable pin is urged in a direction of being inserted to a conductive tube.

The spring 50 is a coil spring obtained by processing a general metal wire rod such as a piano wire, a stainless wire, or the like in a shape of a coil. One end of the spring 50 contacts the bottom of the conductive tube 40 and the other end contacts the bottom of the cylindrical portion 31 of the insulator 30, and thus, the spring 50 urges the bottom of the conductive tube 40 and the cylindrical portion 31 of the insulator 30 in opposite directions to each other. The spring 50 urges the movable pin 10 in a direction, in which the movable pin 10 protrudes from the conductive tube 40, via the insulator 30. Accordingly, a contact force with respect to a counterpart terminal that is not illustrated is applied to the movable pin 10. FIG. 2 illustrates a state where the movable pin 10 is in contact with a counterpart terminal (not illustrated) to compress the spring 50 and is moved in a direction of being inserted into the conductive tube 40.

According to the embodiment, following effects may be obtained.

(1) The plate spring contact 20 that electrically connects the movable pin 10 to the conductive tube 40 is provided, and the plate spring contact 20 includes a plurality of plate springs 22 that are provided around the movable pin 10 and elastically contact the inner circumferential surface of the conductive tube 40, respectively. Thus, an electric current can be dispersed due to multiple-point contacts between the plate spring contact 20 and the conductive tube 40, and accordingly, a total resistance value is reduced and heat generation can be prevented. Also, since the inner circumferential surface of the connecting portion 21 of the plate spring contact 20 is in contact with the outer circumferential surface of the cylindrical portion 15 of the movable pin 10 over a large area, a resistance value of the contact portion is reduced and the heat generation is prevented. Also, even when the inner circumferential surface of the connecting portion 21 is not in contact with the outer circumferential surface of the cylindrical portion 15 of the movable pin 10, the plate spring contact 20 is in contact with (electrically connected to) the opening end of the cylindrical portion 15 of the movable pin 10 via the plurality of tongue portions 21*a*, and thus, the electric current can be dispersed by the numbers of tongue portions 21*a*, the total resistance value is reduced, and the heat generation is prevented. In addition, each of the tongue portions 21*a* is urged towards the opening end of the cylindrical portion 15 of the movable pin 10 by the spring 50 and thus is in surface contact with the opening end of the cylindrical portion 15 over a relatively large area, and accordingly, the resistance value of the contact portion is reduced and the heat generation is prevented. As described above, when the heat generation is prevented, deterioration of the stress in the spring 50 can be prevented.

(2) Since the movable pin 10 and the spring 50 are insulated from each other by the insulator 30, it is possible to prevent the electric current from flowing in the spring 50 (to prevent the spring 50 from being a current path), and a risk of burning of the spring 50 can be decreased. Also, the insulator 30 acts as a member for urging each tongue portion 21*a* of the plate spring contact 20 against the opening end of the cylindrical portion 15 of the movable pin 10 (for preventing a dislocation of the plate spring contact 20 from the movable pin 10), and thus, an increase in the number of components can be prevented.

Although the present invention has been described with reference to the embodiment as an example, it is understood by those skilled in the art that various modifications can be made to each constituent element and each process of the embodiment within the scope described in the claims. Hereinafter, a modified example will be described below.

Figure 5:
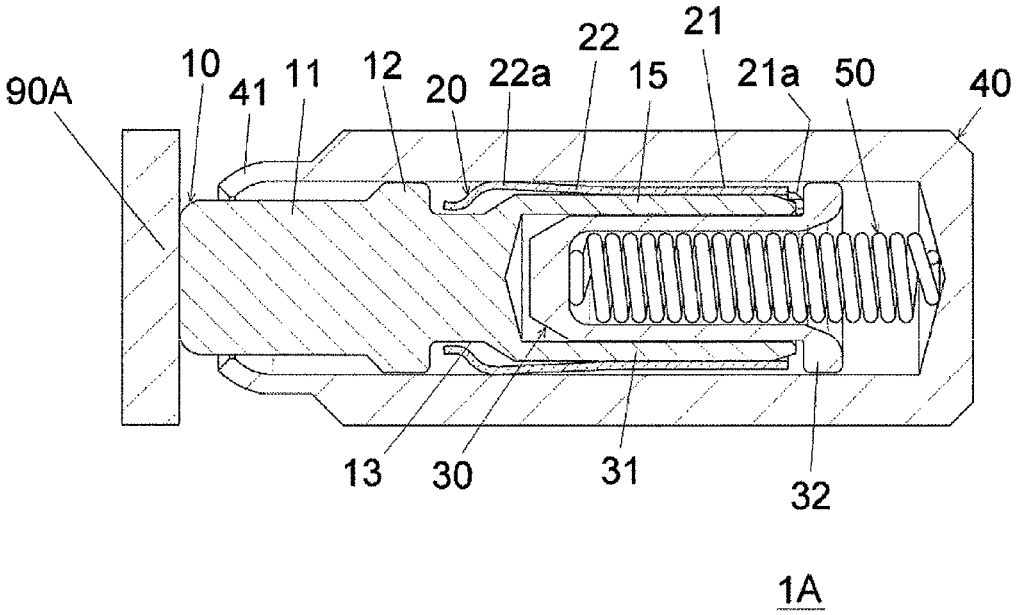
FIG. 5 is a cross-sectional view of a spring connector, in which a tip end of the movable pin has a plane shape, according to an embodiment.
Figure 6:
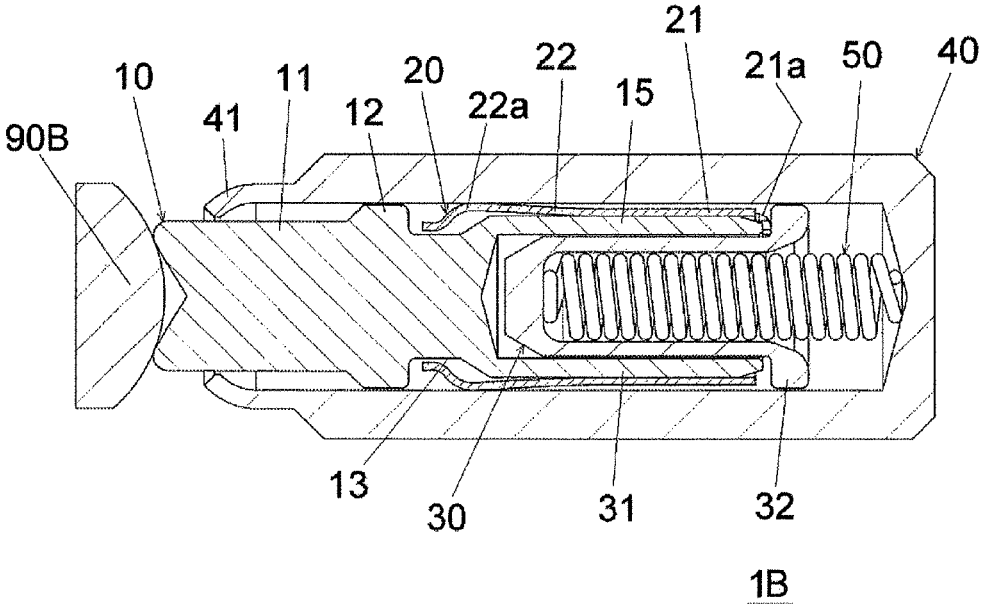
FIG. 6 is a cross-sectional view of a spring connector, in which a tip end of the movable pin has a ridge shape.

FIG. 5 is a cross-sectional view of a spring connector 1A according to an embodiment, in which a tip end of the movable pin 10 has a plane shape. FIG. 6 is a cross-sectional view of a spring connector 1B according to an embodiment, in which the tip end of the movable pin 10 has a ridge shape. In the spring connector 1 illustrated in FIG. 1, and the like, the tip end of the movable pin 10 has a spherical shape, but the tip end of the movable pin 10 may have a plane shape to obtain a larger contact area with respect to a counterpart terminal 90A of a plane shape as illustrated in FIG. 5. Alternatively, as illustrated in FIG. 6, the tip end of the movable pin 10 may be provided as a ridge so as to obtain a larger contact area with respect to a counterpart terminal 90B having a spherical shape (ball shape). Here, in the spring connector according to the related art illustrated in FIG. 7, since a tip end contact point of a movable pin 810 has a structure, in which a base end surface is biasedly cut to tilt the movable pin 810 and to obtain an internal connection, there is a limitation that the spring connector contacts the counterpart terminal via only one point so as to be easily inclined with respect to the counterpart terminal of the plane shape, and the high current is concentrated on one contact point and heat of high temperature is generated. On the other hand, according to the embodiment, there is no need to tilt the movable pin 10 due to the structure, in which the internal connection is obtained via the plate spring contact 20. Therefore, the tip end of the movable pin 10 may have the shape illustrated in FIG. 5 or 6 or any kind of shape in order to increase the number of contact points or increase the contact area, whereby the electric current can be dispersed and the heat generation may be prevented.

The insulation between the movable pin 10 and the spring 50 by the insulator 30 may be omitted, and even in this case, an electric resistance between the movable pin 10 and the conductive tube 40 is lowered due to the plate spring contact 20, and thus, the electric current is suppressed from flowing in the spring 50 and the risk of burning of the spring 50 can be decreased. The pulling-out prevention structure of the plate spring contact 20 by using the insulator 30 may be omitted, and instead, the plate spring contact 20 may be fixed to (hooked by) the movable pin 10 by using a retention force of the spring in the connecting portion 21 of the plate spring contact 20.

The plate spring 22 may be only provided on a part around the axial direction of the movable pin 10 to tilt the movable pin 10 and urge the large diameter portion 12 against the inner circumferential surface of the conductive tube 40. In the above case, the insulation between the movable pin 10 and the spring 50 by using the insulator 30 may reduce the risk of burning of the spring 50, and the plate spring contact 20 may be firmly fixed to the movable pin 10 via the insulator 30 (pulling-out prevention).

Any combination of above-described components and, any one of a method or a system that adapts the description of the present invention into respective forms is valid as an aspect of the present invention.

According to the first aspect of the present invention, it is possible to provide a spring connector capable of preventing heat generation due to an electric current flowing in a conductive tube from a movable pin.

According to the second aspect of the present invention, it is possible to provide a spring connector capable of reducing a risk of burning of a spring.

What is claimed is:

1. A spring connector comprising:

a movable pin;

a conductive tube accommodating a base portion of the movable pin;

a spring provided in the conductive tube so as to urge the movable pin in a direction, in which the movable pin protrudes from the conductive tube;

a conductive plate spring contact including a plurality of plate springs that electrically connect the movable pin and the conductive tube to each other; and an insulator that urges a fixing portion of the plate spring contact against the movable pin in the conductive tube by receiving a biasing force of the spring, wherein the plurality of plate springs are provided around an entire circumference of the movable pin and are in elastic contact at multiple points with an inner circumferential surface of the conductive tube, respectively, so as to electrically connect the movable pin and the conductive tube at the multiple points, and each of the plurality of plate springs has a cantilever structure extended from the base portion of the movable pin.

2. The spring connector according to claim 1, wherein the insulator insulates the movable pin and the spring from each other.

3. The spring connector according to claim 1, wherein the movable pin includes a cylindrical portion with an opening in the base portion thereof, the insulator includes a cylindrical portion located in the cylindrical portion of the movable pin and a flange portion having a diameter that is greater than an inner diameter of the opening of the base portion of the movable pin, the spring extends in the cylindrical portion of the insulator, and the fixing portion of the plate spring contact is supported between the flange portion and the base portion of the movable pin.

4. The spring connector according to claim 1, wherein the plate spring contact includes a connecting portion which connects at least one ends of the plurality of plate springs to one another.

5. The spring connector according to claim 1, wherein the fixing portion includes a plurality tongue portions, each of which curves inward in a radial direction and extends between the movable pin and the insulator.

6. The spring connector according to claim 5, wherein the insulator includes a cylindrical portion that is located inside the movable and accommodates at least part of the spring, and a flange portion provided at one end of the cylindrical portion to urge the plurality of tongue portions towards the movable pin.

7. The spring connector according to claim 1, wherein the insulator includes an insulating resin molded body.

8. A spring connector comprising:

a movable pin;

a conductive tube accommodating a base portion of the movable pin;

a spring provided in the conductive tube so as to urge the movable pin in a direction, in which the movable pin protrudes from the conductive tube;

a plate spring contact including a plurality of plate springs that electrically connect the movable pin and the conductive tube to each other, and a fixing portion that is formed on an end portion of the plate spring contact at a side of the base portion of the movable pin; and an insulator that urges the fixing portion of the plate spring contact against the base portion of the movable pin in the conductive tube by receiving a biasing force of the spring, wherein each of the plurality of plate springs is in elastic contact with an inner circumferential surface of the conductive tube, and the insulator insulates the movable pin and the spring from each other.

9. The spring connector according to claim 8, wherein the movable pin includes a cylindrical portion with an opening in the base portion thereof, the insulator includes a cylindrical portion located in the cylindrical portion of the movable pin and a flange portion having a diameter that is greater than an inner diameter of the opening of the base portion of the movable pin, the spring extends in the cylindrical portion of the insulator, and the fixing portion of the plate spring contact is supported between the flange portion and the base portion of the movable pin.

10. The spring connector according to claim 9, wherein the fixing portion includes a plurality of tongue portions, each of which curves inward in a radial direction and extends between the movable pin and the insulator, the cylindrical portion of the insulator accommodates at least part of the spring, and the flange portion of the insulator is provided at one end of the cylindrical portion to urge the plurality of tongue portions towards the movable pin.

11. The spring connector according to claim 8, wherein the plate spring contact includes a connecting portion which connects at least one ends of the plurality of plate springs to one another.

12. The spring connector according to claim 8, wherein each of the plurality of plate springs comprises a cantilever structure that elastically contacts the inner circumferential surface of the conductive tube.

13. The spring connector according to claim 8, wherein each of the plurality of plate springs includes a curved portion that elastically contacts the inner circumferential surface of the conductive tube, and an edge that is bent inward in a radial direction.

14. The spring connector according to claim 8, wherein the plate spring contact includes a connecting portion in between the plurality of plate springs and the fixing portion.

15. The spring connector according to claim 8, wherein the fixing portion includes a plurality of tongue portions, each of which curves inward in a radial direction and extends between the movable pin and the insulator.

16. The spring connector according to claim 8, wherein the insulator includes an insulating resin molded body.

17. A spring connector comprising:

a movable pin;

a conductive tube accommodating a base portion of the movable pin;

a spring provided in the conductive tube so as to urge the movable pin in a direction, in which the movable pin protrudes from the conductive tube; and a conductive plate spring contact including a plurality of plate springs that electrically connect the movable pin and the conductive tube to each other, wherein the plurality of plate springs are provided around an entire circumference of the movable pin and are in elastic contact at multiple points with an inner circumferential surface of the conductive tube, respectively, so as to electrically connect the movable pin and the conductive tube at the multiple points, each of the plurality of plate springs has a cantilever structure extended from the base portion of the movable pin, the conductive plate spring contact includes a fixing portion that is formed on an end portion of the conductive plate spring contact at a side of the base portion of the movable pin, and the fixing portion includes a plurality tongue portions, each of which curves inward in a radial direction and electrically connects to the base portion of the movable pin.

18. The spring connector according to claim 17, wherein each of the plurality of plate springs includes a curved portion that elastically contacts the inner circumferential surface of the conductive tube, and an edge that is bent inward in a radial direction.

19. The spring connector according to claim 17, wherein the plate spring contact includes a connecting portion in between the plurality of plate springs and the fixing portion.

20. The spring connector according to claim 19, wherein the cantilever structure is extended from the connecting portion toward a tip end of the movable pin in a radially outward direction.

* * * * *